US008919171B2

(12) United States Patent
Tomizawa et al.

(10) Patent No.: US 8,919,171 B2
(45) **Date of Patent: *Dec. 30, 2014**

(54) METHOD FOR THREE-DIMENSIONALLY BENDING WORKPIECE AND BENT PRODUCT

(75) Inventors: Atsushi Tomizawa, Mino (JP); Fumihiko Kikuchi, Tokyo (JP); Shinjiro Kuwayama, Wakayama (JP)

(73) Assignees: Nippon Steel & Sumitomo Metal Corporation, Tokyo (JP); Nippon Steel & Sumikin Pipe Co., Ltd., Tokyo (JP)

( * ) Notice: Subject to any disclaimer, the term of this patent is extended or adjusted under 35 U.S.C. 154(b) by 650 days.

This patent is subject to a terminal disclaimer.

(21) Appl. No.: 12/718,367

(22) Filed: Mar. 5, 2010

(65) Prior Publication Data

US 2010/0218580 A1 Sep. 2, 2010

Related U.S. Application Data

(63) Continuation-in-part of application No. 11/896,319, filed on Aug. 31, 2007, now abandoned, which is a continuation of application No. PCT/JP2006/303220, filed on Feb. 23, 2006.

(30) Foreign Application Priority Data

Mar. 3, 2005 (JP) ..... 2005-059571
Aug. 24, 2005 (JP) ..... 2005-242441

(51) Int. Cl.
*B21D 7/04* (2006.01)
*B21D 7/08* (2006.01)
*B21D 7/16* (2006.01)

(52) U.S. Cl.
CPC ... *B21D 7/08* (2013.01); *B21D 7/16* (2013.01)
USPC ..... 72/369; 72/342.6; 72/128

(58) Field of Classification Search
USPC ..... 72/342.6, 128, 149, 154, 166, 177, 72/200–202, 206, 214, 342.1, 342.2, 72/342.5, 342.94, 264, 367.1, 369, 72/215–217, 306, 307
See application file for complete search history.

(56) References Cited

U.S. PATENT DOCUMENTS 1,891,338 A 12/1932 Snell
1,996,838 A 4/1935 Snell
(Continued)

FOREIGN PATENT DOCUMENTS

DE 35 23 025 1/1987
DE 3634672 A1 * 4/1988 ..... B21D 7/16
(Continued)

*Primary Examiner* — Shelley Self
*Assistant Examiner* — Pradeep C Battula
(74) *Attorney, Agent, or Firm* — Clark & Brody

(57) ABSTRACT

A method for three-dimensionally bending a workpiece comprises feeding the workpiece by a feeding unit provided at an upstream side of the workpiece, supporting the workpiece by a supporting unit at a downstream side of the feeding unit, processing the workpiece by clamping the workpiece with a three-dimensionally movable unit that is provided downstream of the supporting unit, heating a local part of the workpiece in a temperature range which allows quenching to be performed, applying a bending moment to the heated local part of the workpiece by the three-dimensionally movable unit in association with the supporting position and/or the moving speed of the workpiece after the heating step, and rapidly quenching the heated portion. Even when a high-strength workpiece is bent, it is possible to effectively obtain a product having excellent shape fixability and uniform hardness distribution at low costs for wide application for bending sophisticated automobile parts.

6 Claims, 8 Drawing Sheets

(56) References Cited

U.S. PATENT DOCUMENTS

| | | | | | |
|---|---|---|---|---|---|
| 2,812,004 | A | | 11/1957 | Huet | |
| 3,229,489 | A | | 1/1966 | Huet | |
| 3,368,377 | A | | 2/1968 | Hirayama et al. | |
| 3,473,361 | A | | 10/1969 | Cwik | |
| 3,956,916 | A | | 5/1976 | Herkner et al. | |
| 4,057,989 | A | * | 11/1977 | Takechi et al. | 72/128 |
| 4,061,005 | A | | 12/1977 | Kawanami et al. | |
| 4,062,216 | A | | 12/1977 | Hanamoto et al. | |
| 4,195,506 | A | * | 4/1980 | Kawanami et al. | 72/369 |
| 4,296,919 | A | * | 10/1981 | Sakurai et al. | 266/111 |
| 4,596,128 | A | * | 6/1986 | Ringersma et al. | 72/128 |
| 5,316,849 | A | | 5/1994 | Lu et al. | |
| 5,491,996 | A | * | 2/1996 | Baarman et al. | 72/128 |
| 6,097,012 | A | * | 8/2000 | Shiozuka | 219/602 |
| 6,477,879 | B1 | | 11/2002 | Sawa | |
| 6,626,228 | B1 | * | 9/2003 | Bewlay et al. | 164/463 |
| 6,742,374 | B2 | * | 6/2004 | Ozawa | 72/342.6 |
| 7,104,100 | B2 | | 9/2006 | Saegusa | |
| 7,621,164 | B2 | * | 11/2009 | Fullerton et al. | 72/284 |
| 2002/0170329 | A1 | * | 11/2002 | Ichiryu et al. | 72/166 |
| 2003/0038489 | A1 | | 2/2003 | Renzzulla et al. | |
| 2005/0247699 | A1 | * | 11/2005 | Abbott et al. | 219/543 |
| 2006/0159376 | A1 | * | 7/2006 | Takayama et al. | 384/276 |
| 2006/0200990 | A1 | * | 9/2006 | Koyama et al. | 29/897.2 |
| 2009/0263065 | A1 | * | 10/2009 | Kobayashi et al. | 384/515 |
| 2010/0108199 | A1 | * | 5/2010 | Takayama | 148/318 |
| 2011/0031779 | A1 | * | 2/2011 | Uchida et al. | 296/187.03 |

FOREIGN PATENT DOCUMENTS

| | | |
|---|---|---|
| GB | 754907 | 8/1956 |
| JP | 47-7396 | 3/1972 |
| JP | 50-59264 | 5/1975 |
| JP | 63-5827 | 1/1988 |
| JP | 04-105716 | 4/1992 |
| JP | 05-212450 | 8/1993 |
| JP | 05-302119 | 11/1993 |
| JP | 06-182452 | 7/1994 |
| JP | 06-182453 | 7/1994 |
| JP | 06-182454 | 7/1994 |
| JP | 07-024533 | 1/1995 |
| JP | 50-59263 | 5/1997 |
| JP | 10-140251 | 5/1998 |
| JP | 2000-158048 | 6/2000 |

* cited by examiner (a)

(b)

(a)

(b)

METHOD FOR THREE-DIMENSIONALLY BENDING WORKPIECE AND BENT PRODUCT

This is a continuation-in-part of U.S. application Ser. No. 11/896,319 filed Aug. 31, 2007 now abandoned, which is a continuation of PCT/JP2006/1303220 filed Feb. 23, 2006. The PCT application was not in English as published under PCT Article 21(2).

TECHNICAL FIELD

The present invention relates to a method for bending a workpiece, and more particularly, to a method for effectively bending a workpiece through a three-dimensional continuous bending operation in which the workpiece is three-dimensionally bent in different directions, and to a bent product made by the bending method.

BACKGROUND ART

In recent years, demands for structural metal materials having high strength and light weight have increased in consideration of global environment. For example, in an automobile industry, there are growing demands for the safety of car body, and high-strength and light-weight parts of an automobile are increasingly required, so that parts of an automobile have been developed in order to improve fuel efficiency and collision safety.

In order to meet these demands, a high strength steel sheet having a much higher strength than that in the prior art, for example, a material having high strength with a tensile strength of 780 MPa or more, preferably, 900 MPa or more, has come into widespread use.

Meanwhile, while improving the strength of the steel sheet, the conventional structures of parts of an automobile have been reexamined. Following the above, there is a strong demand for the development of an art for accurately bending a metal material in any of various shapes, such as an art for two-dimensionally or three-dimensionally bending a metal material in different directions, in order to apply to various types of parts of an automobile.

In order to meet the demands for the development of the bending technology, various processing techniques have been proposed. For example, Japanese Patent Application Publication No. 50-59263 and Japanese Patent No. 2816000 disclose a method for bending a metal tube or the like while performing a thermal treatment on the metal tube or the like. Specifically, the following methods are disclosed: a bending method for clamping a leading end of a metal tube or the like with a rotatable arm, heating the metal tube or the like by using a heating unit, appropriately moving the heated portion of the metal tube or the like to bend the heated portion, and cooling down the bent portion (Japanese Patent Application Publication No. 50-59263); and a method for applying torsional and bending force to the heated portion of the metal tube or the like to bend the metal tube or the like while twisting the metal tube or the like (Japanese Patent No. 2816000).

However, the disclosed bending methods are so-called grab bending methods requiring a rotatable arm for clamping the leading end of a metal tube or the like, which makes it difficult to feed the metal tube or the like to be bent at high speed. In addition, the arm needs to make a return movement in order to repeatedly clamp the metal tube or the like, resulting in a remarkable variation in the feeding speed of the metal tube or the like. Therefore, a complicated control is required for a heating or cooling speed, which makes it difficult to ensure predetermined quenching accuracy.

In order to solve the above-mentioned problems of the grab bending method, Japanese Patent Application Publication No. 2000-158048 discloses a high-frequency heating bender based on push bending that supports a push bending roller so as to be movable in three dimensional directions. According to the high-frequency heating bender disclosed in Japanese Patent Application Publication No. 2000-158048, the push bending roller is swung around a workpiece to be bent toward the opposite side of the workpiece, and comes into contact with that, thereby bending the workpiece. Therefore, in a two-dimensional continuous bending operation in which a workpiece is two-dimensionally bent in different directions in, for example, an S shape, a procedure of turning the workpiece by 180 degrees is not needed.

However, in the high-frequency heating bender disclosed in Japanese Patent Application Publication No. 2000-158048, since there is no resort to clamp both side-faces of a workpiece to be bent, the workpiece is likely to be deviated from the intended shape due to the residual stress caused by a cooling operation after the high-frequency heating. Therefore, it is difficult to ensure predetermined dimensional accuracy, which makes it difficult to improve the accuracy of bending, while restricting the processing speed of the workpiece.

DISCLOSURE OF THE INVENTION

As described above, a technique for bending a metal material in various bending shapes to be applied to various parts of an automobile is demanded in association with reassessing the structures of the parts of an automobile. Meanwhile, it is desirable that the metal material have a tensile strength of 900 MPa or more, preferably, 1300 MPa or more, in order to reduce the weight of the metal material. In this case, a metal tube having a tensile strength of about 500 to 700 MPa is bent as a starting material and a thermal treatment is performed on the bent metal tube to improve the strength of the metal tube, thereby obtaining a metal material having high strength.

However, in the grab bending method disclosed in Japanese Patent Application Publication No. 50-59263 and Japanese Patent No. 2816000, since the feeding speed of the metal tube varies significantly, the cooling speed cannot be accurately controlled, and a high degree of quenching accuracy cannot be ensured, which makes it difficult to prevent the occurrence of uneven distortion. As a result, variations in shape occur for the bent metal material, and delayed fracture occurs in the metal material having high strength due to the residual stress. Thus, products made by the grab bending method are not suitable for parts of an automobile.

The invention is designed to solve the above-mentioned problems, and it is an object of the present invention to provide a method for bending a metal material with a high degree of operation efficiency, while the method allowing a high degree of bending accuracy to be ensured even when a metal material is bent in various shapes in association with diversification of structures of automobile parts and further even when a metal material having high strength is bent likewise.

In order to achieve the object, according to an aspect of the present invention, there is provided a method for three-dimensionally bending a workpiece which comprises: feeding the workpiece by a feeding unit from an upstream side of the workpiece; supporting the workpiece by a supporting unit at a downstream side of the feeding unit; and processing the workpiece including the following steps: (a) a clamping step to clamp the workpiece with a three-dimensionally movable unit that is provided at the downstream side of the supporting unit; (b) a heating step to locally heat a portion of the workpiece in a temperature range which allows quenching to be performed, by a heating unit: (c) a forming step to apply a bending moment to said locally heated portion of the workpiece by the three-dimensionally movable unit in association with the supporting position and/or the moving speed of the workpiece after the step (b): and (d) a cooling step to rapidly cool down the heated portion in order to quench the metal material of the workpiece after the step (c).

That is, in the bending of a metal material, the downstream side of the metal material is supported, and a thermal treatment is performed on the metal material while moving the metal material at a predetermined speed, which makes it possible to ensure a predetermined cooling speed. In addition, since the bent metal material is uniformly cooled down, it is possible to obtain a metal material having excellent shape fixability despite high strength, and uniform hardness.

For example, specifically, a blank tube of metal material as a workpiece is successively and continuously heated by a high-frequency heating coil at an $A_3$ transformation point or more and up to a temperature at which coarse grains are not generated, and the locally heated portion of workpiece is plastically deformed by the movable roller die. Then, a cooling medium having water or oil as the main ingredient or other cooling fluids, or otherwise, gas or mist is injected onto the outside surface or both the outside and inside surface of the in-process tube, thereby enabling to ensure a cooling speed of 100° C./sec or more.

According to a second aspect of the present invention, preferably the temperature range of step (b) is over the $A_3$ transformation point of the metal material of the workpiece. More preferably, the cooling rate is more than 100° C./sec in step (d). Further, preferably, the local part of the workpiece to be heated is with a length-wise width of within 30 mm in the axial direction. When the temperature range, the cooling rate and the local part width of the workpiece are controlled, the quenching performance of the workpiece become stable and it is easy to obtain a metal material having excellent shape fixability despite having high strength, and uniform hardness distribution at a low cost.

In this way, the bending method according to the present invention can be widely applied as an art of accurately bending automobile parts.

BRIEF DESCRIPTION OF THE DRAWINGS

FIG. 9A shows the three-dimensionally movable unit having two rollers as roller-dies when a workpiece is a member with a closed cross section, such as a circular tube, FIG. 9(*b*) shows the three-dimensionally movable unit having two rollers when a workpiece is a member with a closed cross section, such as a rectangular tube, or a member with an open cross section, such as a channel, and FIG. 9(*c*) shows the three-dimensionally movable unit having four rollers when a workpiece is a member with a closed cross section, such as a rectangular tube, or a member with an irregular cross section, such as a channel.

BEST MODE FOR CARRYING OUT THE INVENTION

Hereinafter, in light of an overall structure of a three-dimensionally bending machine, an example of the structure of a supporting unit, the structure of a processing section and examples of the structures of heating and cooling units, the structure of a movable unit (comprising rolls as roller-dies), the operation of a preheating unit, and the structure and layout of an articulated robot, the method using the three-dimensionally bending machine according to exemplary embodiments of the present invention will be described with reference to the accompanying drawings.

Figure 1:
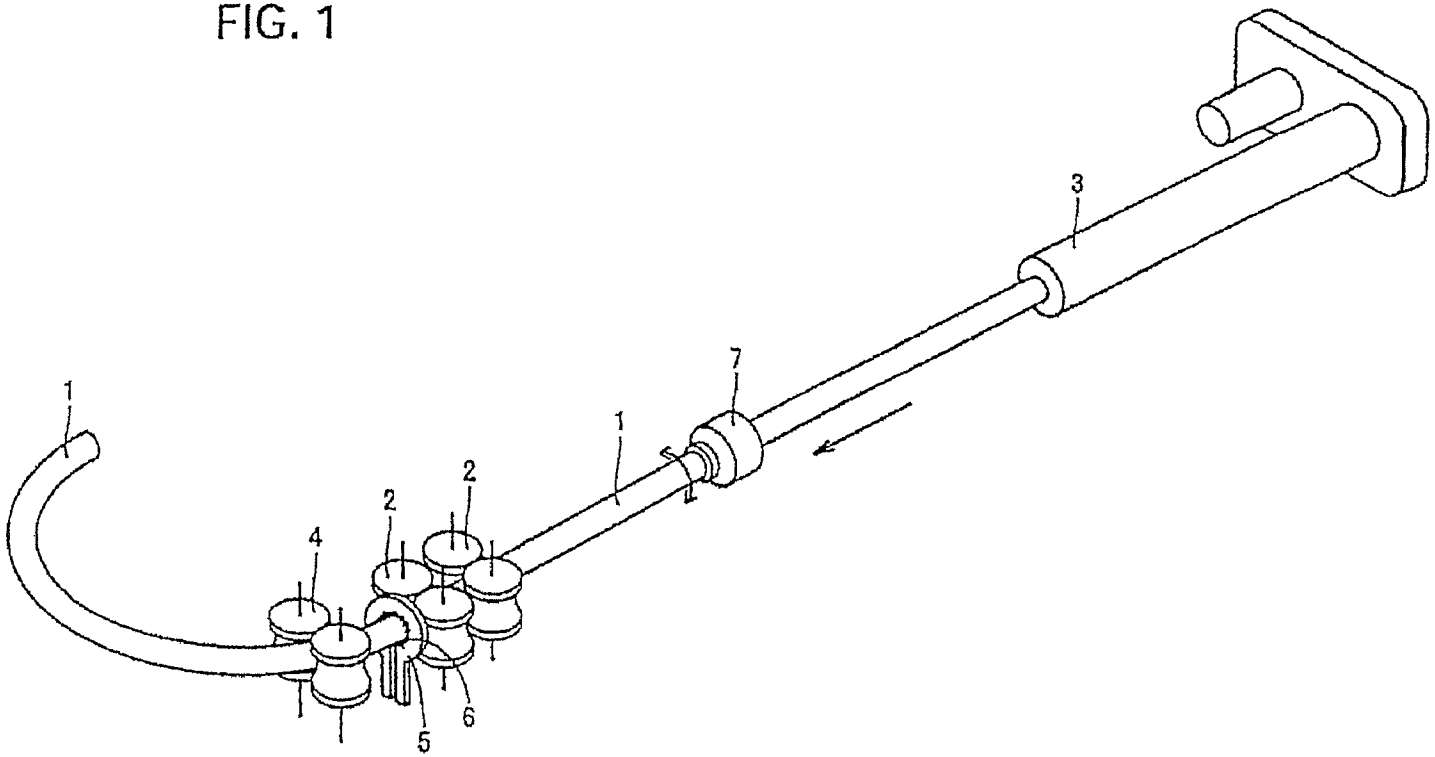
FIG. 1 is a diagram illustrating the overall structure of a three-dimensionally bending machine for performing a bending method according to the present invention.

1. Overall Structure of Three-Dimensionally Bending Machine and Example of Structure of Supporting Unit FIG. 1 is a diagram illustrating the overall structure of a three-dimensionally bending machine for applying a bending method of the present invention. In the bending method, a workpiece 1 as a starting material that is rotatably supported by a supporting unit 2, is successively or continuously fed from an upstream side, and is then bent at a downstream side of the supporting unit 2.

The workpiece 1 made by a metal material such as an alloy shown in FIG. 1 has a circular shape (circular tube) in a sectional view, but the present invention is not limited thereto. Workpieces having various shapes in sectional view may be used. For example, the following materials may be used as the workpiece 1: materials with a closed cross section that have various shapes in sectional view including the circular shape (circular tube) shown in FIG. 1, a rectangular shape, a trapezoidal shape, and other complicated shapes; materials (channels) with an open cross section that are manufactured by, for example, roll forming; materials (channels) with an irregular cross section that are produced by an extrusion process; and rod-shaped materials having various shapes in sectional view (a circular rod, a rectangular rod, and an irregular-shape rod).

Figure 2:
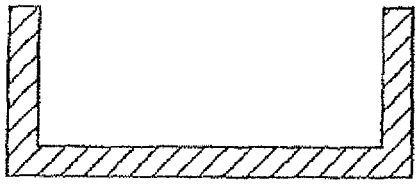
FIGS. 2(*a*) and 2(*b*) are diagrams illustrating the cross-sectional shapes of a workpiece that can be used as a starting material according to the present invention. Specifically, FIG. 2(*a*) shows a channel with an open cross section that is made by roll forming, and FIG. 2(*b*) shows a channel with an irregular cross-section that is made by an extrusion process.
Figure 2:
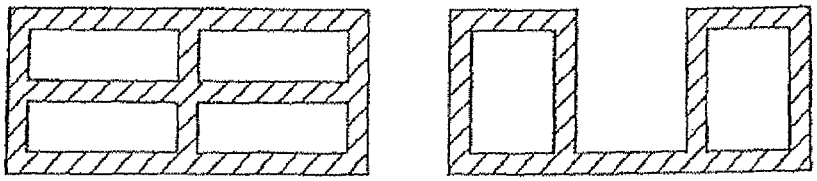

FIGS. 2(*a*) and 2(*b*) are diagrams illustrating the cross-sectional shapes of workpieces that can be used as starting materials according to the present invention. Specifically, FIG. 2(*a*) shows a channel with an open cross section that is produced by, for example, roll forming, and FIG. 2(*b*) shows channels with an irregular cross section that are produced by extruding. In the three-dimensionally bending machine according to the present invention, it is necessary to design the shape of the three-dimensionally movable unit and the supporting unit according to the cross-sectional shape of the workpiece to be used.

The structure of the three-dimensionally bending machine shown in FIG. 1 includes: two pairs of supporting units 2 for rotatably supporting the workpiece 1; a feeding unit 3 that is provided at the upstream side of the supporting units 2 and successively or continuously feeds the workpiece 1; and a three-dimensionally movable unit 4 that is provided at the downstream side of the two pairs of supporting units 2, clamps the workpiece 1, and controls the supporting position of the workpiece 1 and/or the moving speed thereof. The structure of the three-dimensionally bending machine further includes: a high-frequency induction heating coil 5 that is provided around the outer circumference of the workpiece 1 on the entrance side of the three-dimensionally movable unit 4, and locally heats a portion of the workpiece 1; and a cooling unit 6 that rapidly cools down the heated portion of the workpiece 1 to which bending moment is applied.

In the three-dimensionally bending machine shown in FIG. 1, since the workpiece having a circular shape (circular tube) in sectional view is used, supporting rolls are used as the supporting unit 2. For example, a supporting guide may be used according to the cross-sectional shape of a workpiece used. In addition, as shown in FIG. 1, two pairs of supporting rolls are used, but the number of supporting rollers is not limited to two. For example, plural pairs more than one pair or two pairs of supporting rolls, may be used.

Figure 3:
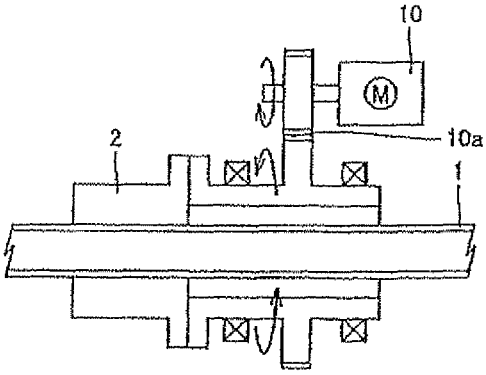
FIGS. 3(*a*) and 3(*b*) are diagrams illustrating an example of the structure of a supporting unit that can be used as a supporting unit of the present invention. Specifically, FIG. 3(*a*) shows the cross-sectional structure of the supporting unit and a rotational mechanism provided in the supporting unit, and FIG. 3(*b*) is a perspective view illustrating the general appearance of the supporting unit.
Figure 3:
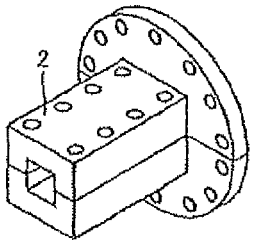

FIGS. 3(*a*) and 3(*b*) are diagrams illustrating examples of the structure of a supporting guide that can be used as the supporting unit of the present invention. Specifically, FIG. 3(*a*) shows the cross-sectional structure of the supporting guide and a rotating mechanism provided in the supporting guide, and FIG. 3(*b*) is a perspective view illustrating the general appearance of the supporting guide 2. The supporting guide 2 shown in FIG. 3 rotatively supports a rectangular tube 1, which is a workpiece, and includes means for preventing the heating of the supporting guide that is disposed close to the heating and cooling unit (the high-frequency induction heating coil 5 shown in FIG. 1). As means for preventing the heating of the supporting guide, it is preferable to construct it using a non-magnetic material. In addition, as shown in FIG. 3(*b*), the supporting guide may be divided into two or more segments, and attaching an insulating material, such as Teflon, to the divided segments is effective to prevent the supporting guide from being heated.

A rotating mechanism including a driving motor 10 and a rotational gear 10*a* is directly connected to the supporting guide 2 such that the supporting guide 2 can be rotated in a circumferential direction in synchronization with the rotation of the feeding unit, which will be described in detail below. Therefore, when the workpiece 1 is to be twisted, it is possible to accurately deform the workpiece 1.

In the three-dimensionally bending machine of the present invention, the supporting rollers shown in FIG. 1 or the supporting guide shown in FIG. 3 can be used as the supporting unit for the workpiece 1. For the purpose of the consistency of explanation, in the following, a mode and an effect will be shown in the case where a round tube is used as the workpiece, and the supporting rollers are used as the supporting unit. In the present invention, it goes without saying that, even when a rod-shaped material or a material with a closed cross section, an open cross section, or an irregular cross section is used instead of the circular tube, or even when the supporting guide is used instead of the supporting rolls, the exactly same effect as described above can be obtained.

2. Structure of Processing Section and Structure of Each of Heating and Cooling Unit.

Figure 4:
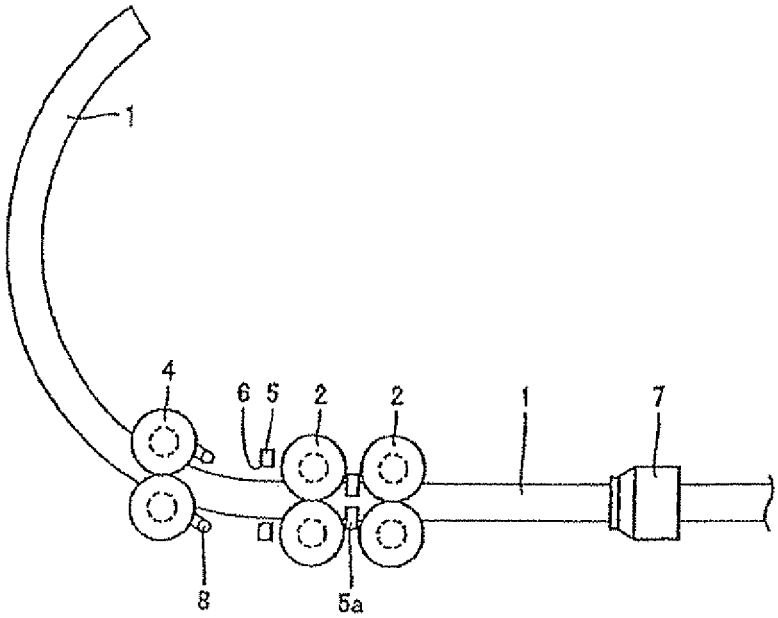
FIG. 4 is a diagram illustrating the structure of a main part of the three-dimensionally bending machine of the present invention.

FIG. 4 is a diagram illustrating the structure of a processing core section of the three-dimensionally bending machine used in the present invention. The two pairs of supporting rollers 2 for supporting the workpiece 1 are provided, and the three-dimensionally movable unit 4 is arranged at the downstream side of the supporting rollers 2. In addition, the high-frequency induction heating coil 5 and the cooling device 6 are arranged on the entrance side of the three-dimensionally movable unit 4. Further, a preheating unit 5*a* is provided between the two pairs of supporting rolls 2, and a lubrication unit 8 for supplying a lubricant is provided in close proximity to the entrance of the three-dimensionally movable unit 4.

In the structure of the three-dimensionally bending machine shown in FIG. 4, the three-dimensionally movable unit 4 clamps workpiece 1 that passes through the two pairs of supporting rolls 2, and controls the clamping position and/or the moving speed thereof. Then, the high-frequency induction heating coil 5 provided around the outer circumference of workpiece 1 locally heats and bends a portion of workpiece 1, followed by a subsequent rapid cooling by means of the cooling device 6 provided around the outer circumference of workpiece 1. During the bending operation, since the high-frequency induction heating coil 5 heats workpiece 1 that passes through the supporting rolls 2, the yield strength of the portion of workpiece 1 to be bent by the three-dimensionally movable unit 4 becomes low, and deformation resistance is lowered, which makes it easy to bend the workpiece 1.

Furthermore, since the three-dimensionally movable unit 4 clamps the workpiece 1 with movable rolls as roller-dies therein, it is possible to retard the generation of seizure defects on the surfaces of rolls despite clamping is done right after heating the workpiece 1. In addition, the lubricant is supplied to the three-dimensionally movable unit. Therefore, even when scales generated from and came off the heated portion of workpiece 1 should get into the three-dimensionally movable unit, the lubricant can prevent the generation of seizure defects on the surface of rolls in the three-dimensionally movable unit.

In the three-dimensionally bending machine of the present invention, since a cooling fluid is supplied to the three-dimensionally movable unit 4 to cool down the three-dimensionally movable unit 4, it is possible to prevent the decrease in strength of the three-dimensionally movable unit 4, the deterioration of the processing accuracy of the three-dimensionally movable unit due to thermal expansion thereof, and the generation of seizure defects on the surface of rolls in the three-dimensionally movable unit.

Figure 5:
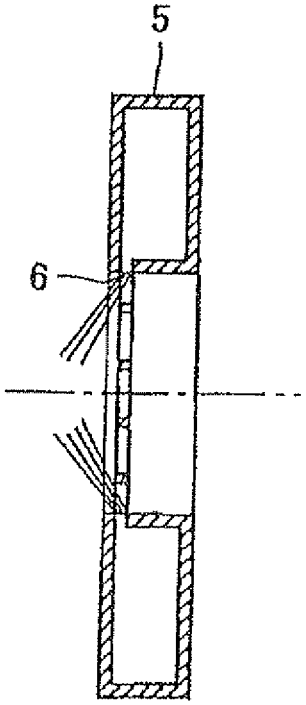
FIG. 5 is a diagram schematically illustrating an example of the structure of a heating and cooling unit provided in the three-dimensionally bending machine of the invention.

FIG. 5 is a diagram schematically illustrating an example of the structure of the heating and cooling unit provided in the three-dimensionally bending machine. The ring-shaped high-frequency induction heating coil 5 is provided around the outer circumference of workpiece to be heated, and heats a portion of workpiece at a temperature which is high enough to enable the heated portion to be locally plastically deformed. Then, a bending moment is applied to the heated portion by action of the three-dimensionally movable unit, and subsequently the cooling device 6 injects the cooling fluid to quench the heated portion. Before high frequency induction heating, the workpiece is held by the two pairs of supporting rollers. In this example of invention embodiment, the heating and cooling devices are integrated into one-piece.

According to this bending method, it is possible to successively and continuously heat a metal material as a workpiece at a temperature which allows coarse grains not to be generated and is an $A_3$ transformation point or more. In addition, the locally heated portion of metal material is plastically deformed by the three-dimensionally movable unit, and then immediately the cooling fluid is injected to the deformed portion, which makes it possible to ensure a cooling rate of 100° C./sec or more.

Thus, the metal material as the workpiece subjected to bending can have excellent shape fixability and stable quality. For example, even when a metal material having low strength is bent as a starting material, it is possible to increase the strength of the metal material by uniform quenching, and thus obtain a metal product having a tensile strength of 900 MPa or more, preferably, 1300 MPa or more.

When the workpiece is thick in wall thickness, there are some cases that it becomes difficult to ensure a cooling rate of 100° C./sec or more. In this regard, when the workpiece is a round tube, a rectangular tube, or a trapezoidal tube with a closed cross section (metal tube), a mandrel as a cooling means can be inserted into the workpiece having the closed cross section.

Figure 6:
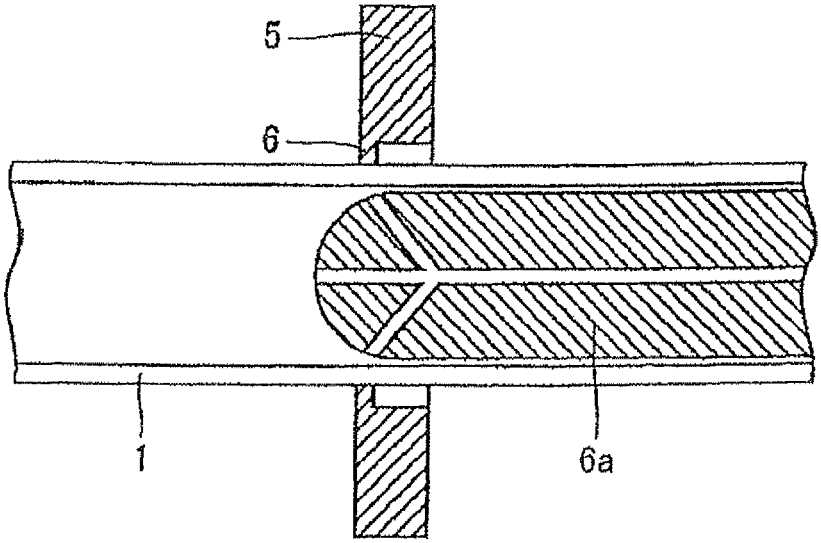
FIG. 6 is a diagram illustrating the structure of a mandrel that is inserted into a metal material as a workpiece having a closed cross section (a metal tube) in order to ensure the cooling rate even for a heavy-wall workpiece.

FIG. 6 is a diagram illustrating the structure of the mandrel that is inserted into the workpiece having the closed cross section (metal tube) in order to ensure the cooling rate of the heavy-wall workpiece. When the workpiece with the closed cross section is thick in wall thickness, a mandrel 6*a* as a cooling means can be inserted into the workpiece. It is possible to ensure the cooling rate by supplying a cooling medium into the mandrel 6*a* in synchronization with the cooling device 6 provided around the outer circumference of the workpiece 1. In this case, a fluid or mist may be supplied into the workpiece 1 to cool down the workpiece 1, and the mandrel 6*a* is desirably made of a non-magnetic material or a refractory material.

In the three-dimensionally bending machine, the cooling medium supplied from the cooling device 6 desirably includes water as a primary component and a rust-preventative agent. When a sliding contact section of the three-dimensionally bending machine is wet by cooling water containing no rust-preventative agent, rust should occur, which may cause serious machine malfunctions. Therefore, it is effective that the rust-preventative agent be contained in the cooling water in order to protect the machine.

Further, it is desirable that the cooling medium supplied from the cooling unit contains water as a primary component, and a quenching agent. For example, a quenching agent mixed with an organic polymer agent has been known. When the quenching agent having a predetermined concentration is mixed with water, it is possible to adjust the cooling rate and thus ensure a stable quenching performance.

3. Structure of Three-Dimensionally Movable Unit

Figure 7:
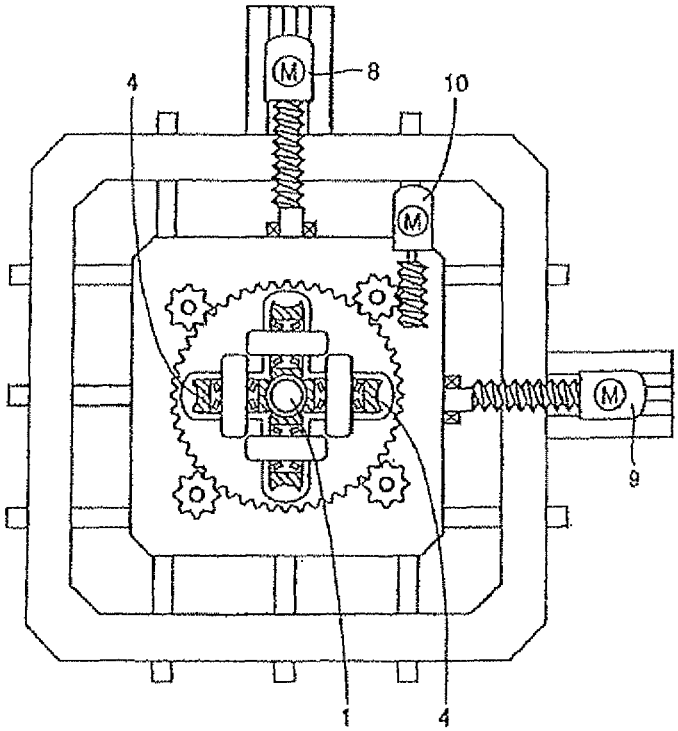
FIG. 7 is a diagram illustrating a shifting mechanism for movement in a vertical and horizontal directions and a rotational mechanism for rotation in a circumferential direction of a three-dimensionally movable unit (comprising rolls as roller-dies) that is provided in the three-dimensionally bending machine of the present invention.

FIG. 7 is a diagram illustrating the structural examples of shifting mechanisms in the three-dimensionally movable unit for moving itself in a vertical and horizontal directions and a rotating mechanism for rotating the same in a circumferential direction, which is employed in the three-dimensionally bending machine of the present invention. The workpiece (circular tube) 1, which is a metal material such as an alloy, is clamped by the three-dimensionally movable unit 4 having four rolls as roller-dies. The shifting mechanism for moving the three-dimensionally movable unit in a vertical direction is operated by a driving motor 8, and the shifting mechanism for moving the three-dimensionally movable unit in a horizontal direction is operated by a driving motor 9. The rotating mechanism for rotating the three-dimensionally movable unit in a circumferential direction is operated by a driving motor 10.

In FIG. 7, although the structure of a tilting mechanism for inclining the three-dimensionally movable unit 4 in a horizontal and vertical planes is not shown, the tilting mechanism of the invention does not need to be limited to a specific structure, and any tilting mechanism in common use may be used.

Figure 8:
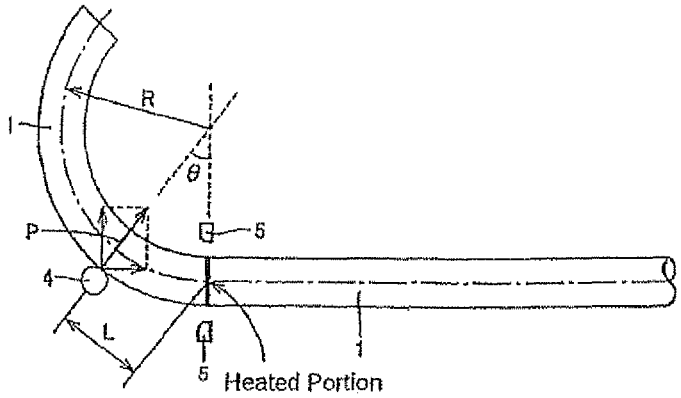
FIG. 8 is a diagram illustrating the operation of a moving mechanism for movement in the forward or backward direction of the three-dimensionally movable unit that is provided in the three-dimensionally bending machine of the present invention.

FIG. 8 is a diagram illustrating the operation of a moving mechanism for moving the three-dimensionally movable unit provided in the bending machine of the present invention in the forward or backward direction. As shown in FIG. 8, when the length of an arm (processed length of the workpiece) is L, a bending moment M required for bending is represented by Expression A given below:

$$M=P\times L=P\times R\cdot\sin\theta. \qquad \text{[Expression A]}$$

Therefore, as the length L of the arm increases, force P exerted on pinch rolls (roller-dies in a three-dimensionally movable unit) 4 becomes smaller. That is, in view of the processing range from a small bending radius to a large bending radius, when the three-dimensionally movable unit 4 can not be moved in the forward or backward direction, the force P, required to process the workpiece 1 so as to have a small bending radius, restricts bending equipment. Therefore, when the length L of the arm is set to be large so as to process the workpiece 1 to have a small bending radius, the shifting mechanisms and the tilting mechanism of the three-dimensionally movable unit require a large stroke for processing the workpiece to have a large bending radius, which results in an increase in the scale of the three-dimensionally bending machine.

Meanwhile, considering an instantaneously stopping accuracy or allowable play (movement runout) of the three-dimensionally bending machine, when the length L of the arm is small, the processing accuracy is lowered. Therefore, it is possible to select the optimum length L of the arm by moving the three-dimensionally movable unit 4 in the forward or backward direction according to the bending radius of the workpiece 1, and thus to widen the available processing range. In this case, it is also possible to ensure sufficient processing accuracy without increasing the scale of the three-dimensionally bending machine.

Furthermore, in the three-dimensionally bending machine of the present invention, the high-frequency induction heating and cooling unit can have, independently or integrally, a moving mechanism for moving the unit in the forward or backward direction. This structure makes it possible to ensure synchronizing with the three-dimensionally movable unit and to heat the leading end of workpiece at the beginning of bending. As a result, it is possible to improve workability and operability when the workpiece is mounted or demounted.

Figure 9:
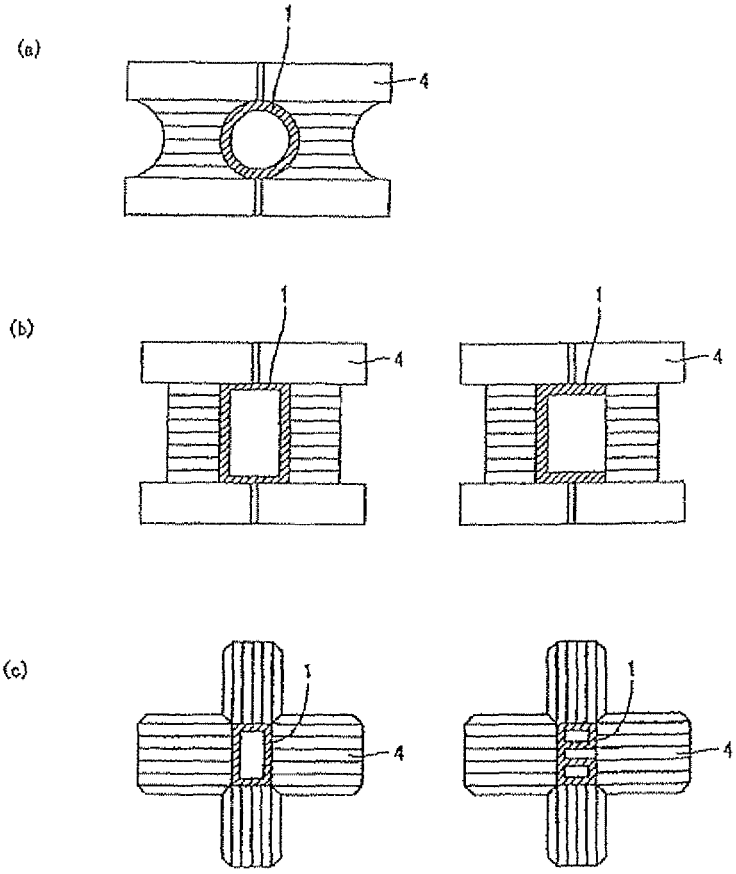
FIGS. 9(*a*) to 9(*c*) are diagrams illustrating example configurations of the three-dimensionally movable unit that is provided in the three-dimensionally bending machine. Specifically.

FIGS. 9(*a*) to 9(*c*) are diagrams illustrating examples of the configuration of the three-dimensionally movable unit provided in the three-dimensionally bending machine. Specifically, FIG. 9(*a*) shows a three-dimensionally movable unit including two rolls as roller-dies when a workpiece is a member with a closed cross section such as a round tube, FIG. 9(*b*) shows a three-dimensionally movable unit including two rolls when a workpiece is a member with a closed cross section such as a rectangular tube or a material with an open cross section, such as a channel, and FIG. 9(*c*) shows a three-dimensionally movable unit including four rolls when a workpiece is a member with a closed cross section such as a rectangular tube or a member with an irregular cross section, such as a channel.

The roll caliber type of the three-dimensionally movable unit 4 can be designed according to the cross section of the workpiece 1. The number of rolls is not limited to 2 or 4, as shown in FIGS. 9(*a*) to 9(*c*), but the three-dimensionally movable unit may include three rolls. In general, the metal material as a workpiece to be bent can have a closed cross section with a circular shape, a rectangular shape, a trapezoidal shape, or a complex shape, an open cross section formed by a roll forming operation, or an irregular cross section formed by an extrusion process. However, when the workpiece 1 has a substantially rectangular cross section, as shown in FIG. 9(*c*), it is desirable that the three-dimensionally movable unit includes four roller-dies.

In the three-dimensionally bending machine according to the present invention, as shown in FIG. 7, a rotating mechanism for rotating in a circumferential direction can be provided in the three-dimensionally movable unit 4 in order to twist the workpiece. At the same time, although not shown in FIG. 1, the feeding unit 3 can be provided with a chucking mechanism 7 capable of holding and rotating the workpiece 1 in a circumferential direction, which serves as a rotating mechanism.

Therefore, in order to twist the workpiece, the following methods of the present invention can be used a method of twisting the leading end of the workpiece using the rotating mechanism of the three-dimensionally movable unit; and a method for twisting the rear end of the workpiece using the rotating mechanism of the feeding unit. In general, when the method of twisting the rear end of the workpiece using the rotating mechanism of the feeding unit is employed, a compact machine structure is obtained. On the other hand, in the method of twisting the leading end of the workpiece using the rotating mechanism of the three-dimensionally movable unit, as shown in FIG. 7, there is an issue that the scale of the three-dimensionally bending machine will become large. However, both the methods can be used to twist the workpiece.

In the three-dimensionally bending machine of the present invention, a rotating mechanism for rotating in a circumferential direction may be provided in the supporting unit (the supporting rolls or the supporting guide), which makes it possible to rotate the workpiece in a circumferential direction in synchronization with the rotation of the feeding unit. Either the method of twisting the leading end of workpiece using the rotating mechanism of the three-dimensionally movable unit or the method of twisting the rear end of the workpiece using the rotating mechanism of the feeding unit can be used to accurately twist the workpiece in synchronization with the supporting unit.

In the three-dimensionally bending machine of the present invention, a roller-die driving and rotating mechanism may be provided in the three-dimensionally movable unit. In this case, the roller-die can be driven to revolve by, for example, a driving motor according to the feed amount of the workpiece fed by the feeding unit. That is, when a compressive stress exerted on a bent portion is reduced and the revolving speed of the roller dies of the three-dimensionally movable unit is controlled so as to be synchronized with the feed amount of the workpiece fed by the feeding unit, it is possible to apply a tensile stress to the bent portion, and the available bending range can be widened. In addition, it is possible to improve the bending accuracy of the metal product.

4. Preheating Unit and Operation Thereof.

The three-dimensionally bending machine of the present invention includes a preheating unit at the upstream side of the heating unit. The preheating unit can perform preferential heating or otherwise, two- or more-stage, i.e., plural-stage heating on the workpiece. When the preheating unit performs plural-stage heating, it is possible to disperse heating load on the workpiece, and thus improve bending efficiency.

Figure 10:
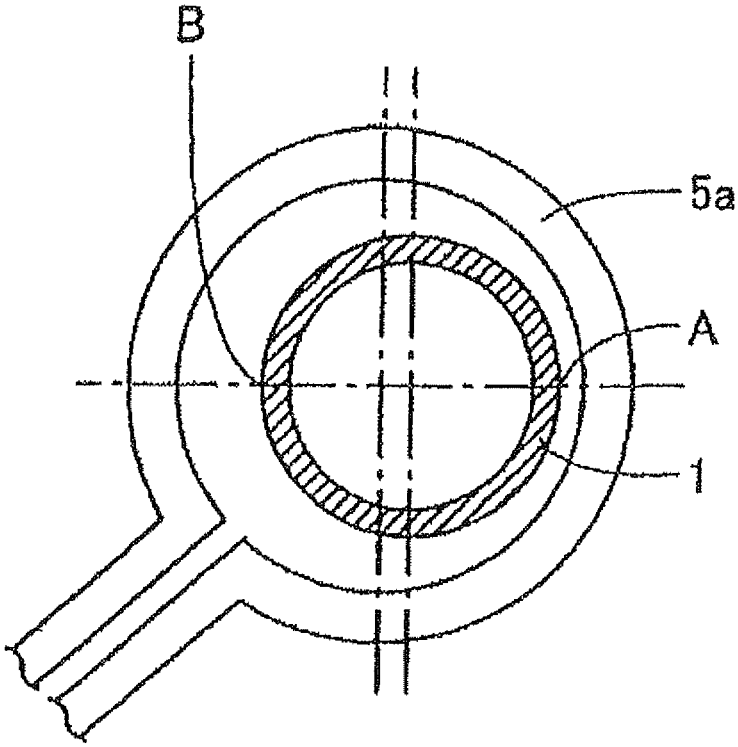
FIG. 10 is a diagram illustrating the operation of a preheating unit for performing preferential heating on a metal material.

FIG. 10 is a diagram illustrating the operation of the preheating unit that performs preferential heating on the workpiece. When the high-frequency induction preheating coil 5*a* is used as the preheating unit to perform preferential heating on the workpiece 1, the workpiece 1 is disposed while being off-set relative to the centerline axis of the high-frequency induction preheating coil 5*a* in consideration of an orientation to which the workpiece is bent by the three-dimensionally movable unit. Thus, the heating temperature of the portion of the workpiece 1 intended to be the inner radius side of the bend can be controlled to be lower than that of the outer radius side of the bend.

Specifically, in FIG. 10, the workpiece 1 is disposed such that a portion A is close to the high-frequency induction preheating coil 5*a*, so that the temperature of the outer surface of portion A corresponding to the outer radius side of the bent portion is higher than the temperature of the outer surface of portion B corresponding to the inner radius side of the bent portion. Such configuration of the heated portion of the workpiece 1 can effectively prevent wrinkles on the inner radius side of the bent portion and cracking on the outer radius side of the bent portion from being generated.

In the three-dimensionally bending machine of the present invention, a lubricant can be supplied to the three-dimensionally movable unit. Therefore, even when scales generated from the heated portion of the workpiece are got into rolls in the three-dimensionally movable unit, the lubricant can retard the generation of seizure defects on the surface thereof.

Similarly, in the three-dimensionally bending machine of the present invention, a cooling fluid can be supplied to the three-dimensionally movable unit. A cooling device for the movable unit is provided in the three-dimensionally movable unit in the vicinity of a position where the workpiece is to be supported, and the cooling fluid is supplied to the three-dimensionally movable unit through the cooling device. In this way, the three-dimensionally movable unit is cooled down by the cooling fluid. As a result, it is possible to prevent a decrease in strength of the three-dimensionally movable unit, the lowering of bending accuracy due to thermal expansion of the three-dimensionally movable unit, and seizure defects on the surface of roller-dies in the three-dimensionally movable unit.

5. Structure and Arrangement of Articulated Robot

Figure 11:
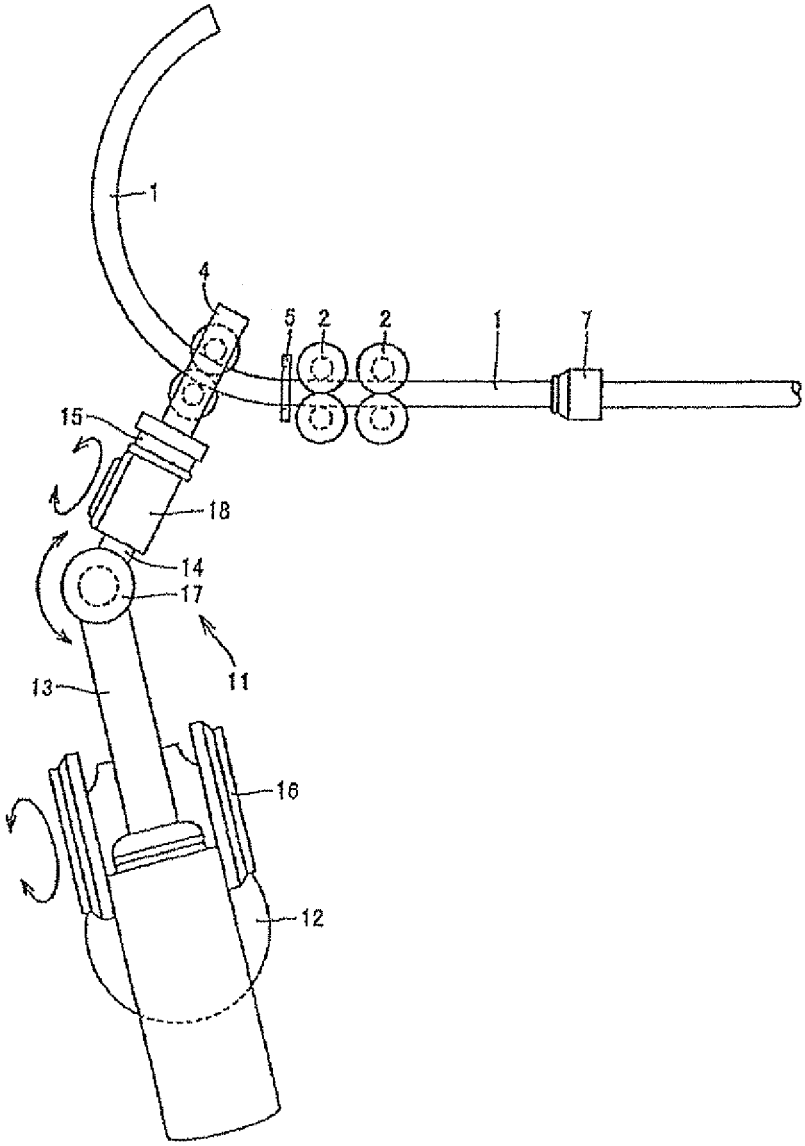
FIG. 11 is a diagram illustrating the overall structure and arrangement of an articulated robot that can be applied to the three-dimensionally bending machine of the present invention.

FIG. 11 is a diagram illustrating the overall structure and arrangement of an articulated robot that is applicable to the three-dimensionally bending machine of the present invention. As shown in FIG. 11, an articulated robot 11 for the three-dimensionally movable unit 4 can be provided at the downstream side of the bending machine.

The articulated robot 11 for the three-dimensionally movable unit includes a fixed surface 12 that is fixed to an operating surface, three arms 13, 14, and 15, and three joints 16, 17, and 18 that connect the arms 13, 14, and 15, respectively, and each of these can rotate about its axis. The three-dimensionally movable unit 4 is attached to the leading arm 15 of the articulated robot 11.

Figure 12:
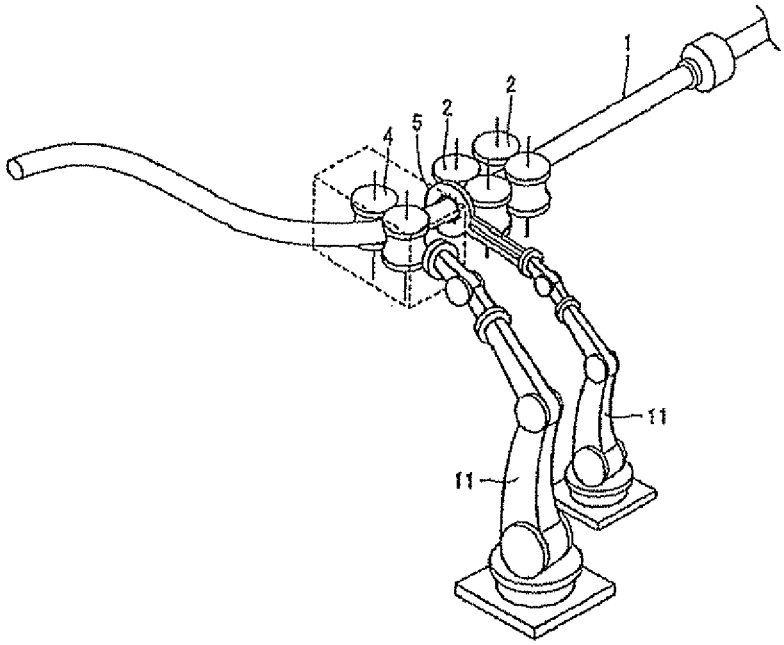
FIG. 12 is a diagram illustrating another example of the structure of the articulated robot that can be applied to the three-dimensionally bending machine of the present invention.

FIG. 12 is a diagram illustrating another example of the structure of the articulated robot that is applicable to the three-dimensionally bending machine of the present invention. In the three-dimensionally bending machine shown in FIG. 11, only the articulated robot for the three-dimensionally movable unit is provided. However, both an articulated robot 11 for use in a heating and cooling units, and the one for use in the three-dimensionally movable unit can be concurrently provided. The use of the two articulated robots makes it possible to further improve bending efficiency.

In the three-dimensionally bending machine of the present invention, at least one articulated robot having three joints each of which can rotate about its axis is provided, so that, during bending the workpiece, the articulated robots can perform a series of operations, such as forward or backward movement, swirling or rotational motion, and concurrent motion, effected by the shifting mechanism, the tilting mechanism, and the moving mechanism of the three-dimensionally movable unit 4, on the basis of control signals. That is, during bending the workpiece, the articulated robots can perform a total of six types of operations effected by manipulators, on the basis of the control signals. As a result, it is possible to improve bending efficiency and reduce the scale of a three-dimensionally bending machine.

Industrial Applicability

According to a method of bending a metal material as a workpiece according to the present invention, even when there is a need for bending a workpiece in various shapes, such as the case that the workpiece is three-dimensionally bent in different directions in a three-dimensional continuous bending operation, and even when there is a need for bending a workpiece having high strength, the workpiece is uniformly cooled down, so that it is possible to effectively obtain the product having excellent shape fixability despite having high strength, and uniform hardness distribution at a low cost.

Further, since the three-dimensionally movable unit rotatively clamps a workpiece, it is possible to retard the generation of seizure defects on the surface of the three-dimensionally movable unit. Therefore, the accuracy of a bending operation can be ensured, and a bending operation can be performed with a high degree of operation efficiency. In this way, the bending method according to the present invention can be widely applied as an art of bending sophisticated and diversified automobile parts.

The invention claimed is:

1. A method for three-dimensionally bending a metal material as a workpiece comprising:

feeding the workpiece by a feeding unit which is provided at an upstream side of the workpiece;

supporting the workpiece by a supporting unit at a downstream side of the feeding unit; and processing the workpiece by:

(a) a clamping step to clamp the workpiece with a three-dimensionally movable unit that is provided at the downstream side of the supporting unit; the three-dimensionally movable unit comprising two rolls, three rolls, or four rolls;

(b) a heating a local part of the workpiece by a heating unit that is provided at an upstream side of the three-dimensionally movable unit in a temperature range which allows quenching to be performed, (c) applying bending moments in three dimensions to said heated local part of the workpiece by the three-dimensionally movable unit in association with the supporting position and/or the moving speed of the workpiece after the step (b); and (d) rapidly cooling down the heated portion by a cooling unit that is provided between the heating unit and the three-dimensionally movable unit in order to perform quenching after the step (c).

2. The method for three-dimensionally bending the workpiece according to claim 1, wherein said temperature range of the step (b) is over an $A_3$ transformation point of the metal material as the workpiece.

3. The method for three-dimensionally bending the workpiece according to claim 2, wherein the cooling rate is more than 100° C./sec in the step (d).

4. The method for three-dimensionally bending the workpiece according to claim 3, wherein the local part of the workpiece to be heated is with a length-wise width of within 30 mm in the axial direction.

5. The method according to claim 1, wherein the three-dimensionally movable unit includes at least one of a shifting mechanism for moving the three-dimensionally movable unit in a vertical direction, a shifting mechanism for moving the three-dimensionally movable unit in a horizontal direction, a tilting mechanism for inclining the three-dimensionally movable unit in a vertical plane, and a tilting mechanism for inclining the three-dimensionally movable unit in a horizontal plane.

6. The method according to claim 1, wherein the three-dimensionally movable unit includes a rotating mechanism for rotating the three-dimensionally movable unit in a circumferential direction.

* * * * *